US005243393A

United States Patent [19]

Menjo

[11] Patent Number: 5,243,393

[45] Date of Patent: Sep. 7, 1993

[54] ROTATORY MEMBER FOR FIXING AND FIXING DEVICE HAVING THE ROTATORY MEMBER

[75] Inventor: Takeshi Menjo, Tokyo, Japan

[73] Assignee: Canon Kabushiki Kaisha, Tokyo, Japan

[21] Appl. No.: 529,629

[22] Filed: May 29, 1990

[30] Foreign Application Priority Data

May 31, 1989 [JP] Japan ..... 1-138970

[51] Int. Cl.[5] ..... G03G 15/20; G03G 21/00

[52] U.S. Cl. ..... 355/284; 355/282; 355/285

[58] Field of Search ..... 355/282, 284, 285, 286, 355/289, 290, 295; 219/469, 470

[56] References Cited

U.S. PATENT DOCUMENTS 4,501,482 2/1985 Stryjewski ..... 355/290
4,810,564 3/1989 Takahashi et al. ..... 355/284 X
4,842,944 6/1989 Kuge et al. ..... 355/285 X
4,987,457 1/1991 Mochizuki et al. ..... 355/285

FOREIGN PATENT DOCUMENTS 0261511 3/1988 European Pat. Off. .
50-51331 5/1975 Japan .
53-110842 9/1978 Japan .
58-209768 12/1983 Japan .
61-158361 7/1986 Japan .
61-184575 8/1986 Japan .
63-63075 3/1988 Japan .
63-259582 10/1988 Japan .
63-298382 12/1988 Japan .
1-72183 3/1989 Japan .
1-201687 8/1989 Japan .
1-205190 8/1989 Japan .

*Primary Examiner*—Fred L. Braun
*Attorney, Agent, or Firm*—Fitzpatrick, Cella, Harper & Scinto

[57] ABSTRACT

A rotatory member for fixing toner image onto a support member supporting toner image includes a core member, a first rubber layer provided on the core member, a second rubber layer provided on the first rubber layer, and a third rubber layer provided as the surface layer on the second rubber layer. Here, by making the third rubber layer, the second rubber layer and the first rubber layer to have their elongations larger in the order mentioned, peeling between the respective layers is prevented so as to withstand prolonged usage.

16 Claims, 2 Drawing Sheets

ROTATORY MEMBER FOR FIXING AND FIXING DEVICE HAVING THE ROTATORY MEMBER

BACKGROUND OF THE INVENTION

1. Field of the Invention

This invention relates to rotatory members for fixing, such as fixing rolls, etc. for fixing a toner image, onto a support member supporting the toner image and to a fixing device having the rotatory members. Particularly, it relates to a rotatory member for fixing having elastic layers constituted of a plurality of layers for prevention of swelling with a mold release or parting agent and a fixing device provided with the rotatory member.

2. Related Background Art

As a device for fixing toner image, the hot roll fixing device has been generally employed, and in such hot roll fixing device, it has been widely to prevent off-set phenomenon of toner by coating the fixing rolls with a mold release agent such as silicone-oil, etc.

Particularly, in a full-color image forming device which mixes toners with different plural colors, the fixing roll is required to have very high mold releasability, and for that purpose, the fixing roll is coated with a large amount of a mold release agent.

An example of such full-color image forming device is described below.

Formation of a latent image of an image on a photosensitive drum by color resolution signals of an original, formation of a toner image by coloration of the latent image with color toner, and transfer of the toner image onto a recording material are repeated one by one for each color. By doing so, for example, a full-color image is formed on a recording material, and a plurality of unfixed toner images formed on the recording material are fixed by an image fixing device arranged within the image forming device.

The image fixing device, as shown in FIG. 2, has a rotatory member for fixing, a fixing roller 1 which is generally made a roller shape and a pressurizing roller 2 opposed thereto, and is further equipped with a mold release agent coating means 3 for coating the fixing roller 1 with silicone oil as the mold release agent, and a cleaning means 4 for cleaning the fixing roller 1.

The fixing roller 1 comprises an elastic layer 6 comprising an HTV silicone rubber (high temperature vulcanization type silicone rubber) formed on a hollow core metal 5 generally made of aluminum as the substrate, an oil barrier layer F comprising a fluorine rubber on the elastic layer 6, and further an off-set prevention layer 7 comprising an RTV silicone rubber (room temperature vulcanization type silicone rubber) as the surface layer thereon, with the outer diameter being made, for example, 40 mm.

The pressurizing roller 2 comprises an elastic layer 9 comprising an HTV silicone rubber formed on a hollow core metal 8 made of aluminum, and a resin layer 10 such as of fluorine resin, etc. on the elastic layer 9, with the outer diameter being similarly made, for example, 40 mm.

Within the core metal 5 of the fixing roller 1 and the core metal 8 of the pressurizing roller 2, halogen heaters 11, which act as heating sources, are respectively arranged. The temperature of the pressurizing roller 2 :s detected with thermistors 12 in contact therewith to effect on-off control of the halogen heaters 11, whereby the temperatures of the fixing roller 1 and the pressurizing roller 2 are maintained constantly at about 170 ° C.

The mold release agent coating means 3 is adapted to aspirate the silicone oil 14 with a viscosity of 300 CS housed within the vessel 13 by means of the upper and lower supplying rollers 15A, 15B to coat the off-set prevention layer 7 of the fixing roller 1 with the oil. The amount of the silicone oil coated onto the off-set prevention layer 7 is controlled by the contact angle and the pressure of the oil amount controlling blade 16 in contact with the upper supplying roller 15A.

The cleaning means 4 removes the toner off-set onto the off-set prevention layer 7 of the fixing roller 1. Here, in the example shown, a web-shaped cleaning member is employed.

According to the fixing device as described above, a recording material P carrying a plurality of unfixed toner images T laminated thereon is conveyed in the direction of the arrow a by a conveying device (not shown), and the recording material P passes between the fixing roller 1 and the pressurizing roller 2 each rotated in the direction of the arrowhead b by a driving device (not shown) whereby the laminated toner images T can be mixed and thermally fixed on the recording material P to form a full-color image.

As mentioned above, the fixing roller 1 has an oil barrier layer F comprising a fluorine rubber, and therefore penetration of the silicone oil into the HTV silicone rubber layer 6 of the lower layer is prevented by the oil barrier layer F. Also, the silicone oil is held on the RTV silicone rubber layer 7 which is the upper layer of the barrier layer F, whereby high mold releasability can be obtained.

However, when a roller having an intermediate layer as such oil barrier layer is employed, stresses occur between the respective layers of the fixing roller through heat and pressure during fixing, and slippage with the pressurizing roller, etc., thus involving the problem that peeling occurs between the elastic layer of the lower layer and the oil barrier layer or between the oil barrier layer of the upper layer and the off-set prevention layer, whereby the roller cannot withstand prolonged usage.

The present invention has been accomplished in view of such problems.

SUMMARY OF THE INVENTION

It is an object of the present invention to provide a rotatory member for fixing which can withstand prolonged usage and a fixing device having the rotatory member.

It is another object of the present invention to provide a rotatory member for fixing which has prevented occurrence of peeling between its plural layers and a fixing device having the rotatory member.

It is still another object of the present invention to provide a rotatory member for fixing which is free from swelling with a mold release agent and a fixing device having the rotatory member.

Other objects than those mentioned above and the specific features will become more apparent by reading the detailed description shown below by referring to the accompanying drawings.

DETAILED DESCRIPTION OF THE PREFERRED EMBODIMENTS

Figure 1:
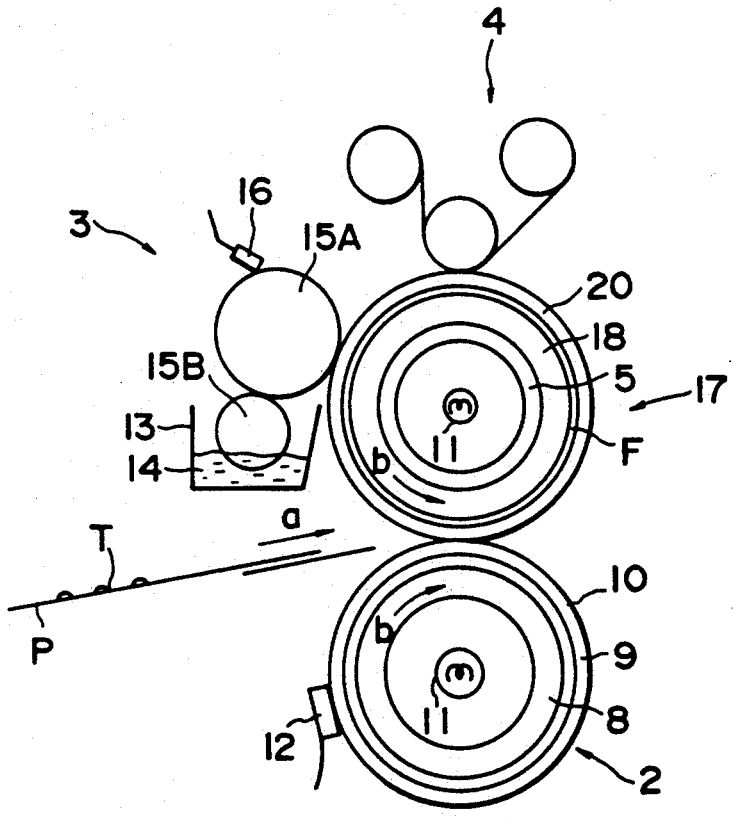
FIG. 1 is a schematic sectional view showing the fixing device of an embodiment of the present invention.

The present invention is described in detail by referring to FIG. 1.

Figure 2:
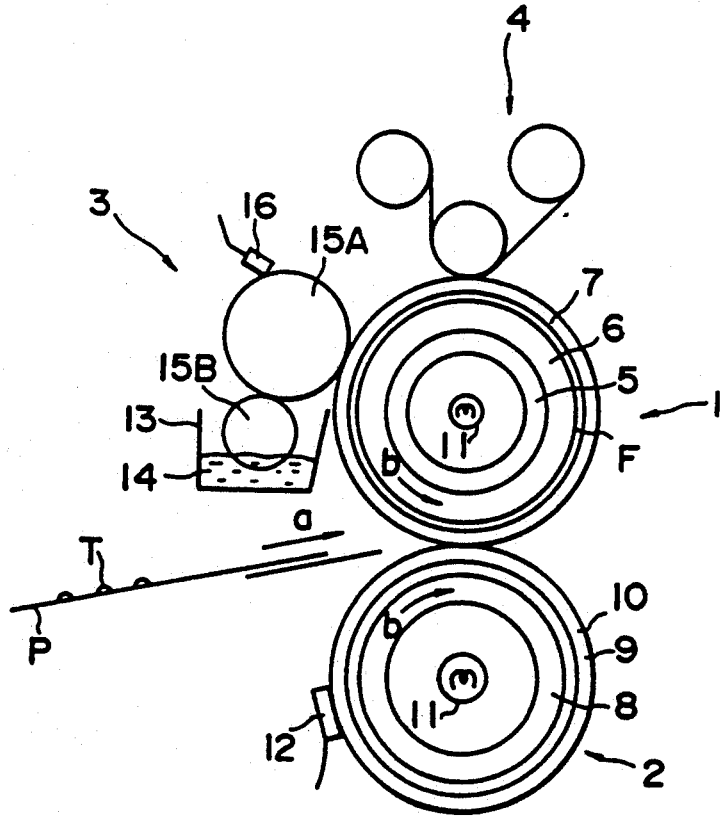
FIG. 2 PRIOR ART
FIG. 2 is a schematic sectional view showing the fixing device of the prior art.

The members playing the same functions as the members in FIG. 2 are affixed with the same numerals, and their descriptions are omitted.

The fixing roller 17 has an elastic layer 18 comprising a methylphenyl HTV silicone rubber formed on a hollow core metal 5 generally made of aluminum as the substrate, an oil barrier layer F which is an elastic layer comprising a fluorine rubber formed on the elastic layer 18, and an elastic layer 20 comprising an RTV silicone rubber formed on the oil barrier layer F to form a surface layer, which surface layer is made an off-set prevention layer.

For the above-mentioned elastic layer 18, various materials can be used, but methylphenyl HTV silicone rubbers excellent in tensile strength, thermal conductivity, elasticity and adhesiveness with the core metal 5 are preferable. Preferably, a methylphenyl HTV silicone rubber with high thermal conductivity may be employed. This is because, by making the elastic layer 18 highly thermally conductive, heat can be supplied rapidly to the surface of the fixing roller 17 to prevent lowering of the surface temperature of the fixing roller 17 through paper passage of the recording material P, whereby the unfixed toner image T carried on the recording material can be fixed stably in temperature.

Particularly, in fixing of full-color image, the surface temperature of the fixing roller 17 influences greatly color mixing of toner, and the change in surface temperature will have influence as the change in color tint of the color image. Therefore, it is particularly preferable to form the elastic layer 18 of a methylphenyl HTV silicone rubber with high thermal conductivity.

In this embodiment, the thermal conductivity of the elastic layer 18 is made $0.5\times10^{-3}$ cal/cm·sec·° C., but more preferably it should be about $1.0\times10^{-3}$ cal/cm·sec·° C.

The oil barrier layer F comprising a fluorine rubber is formed after coating of a primer on the elastic layer 18. The thickness of the oil barrier layer F may be preferably 5 to 300 μm. With a thickness of the oil barrier layer F less than 5 μm, there is the fear that the elastic layer 18 therebeneath may be exposed partially by coating irregularity of the fluorine rubber, etc., whereby penetration of the silicone oil into the elastic layer 18 can be prevented incompletely by the oil barrier layer F. On the contrary, if it exceeds 300 μm, increase of hardness of the fixing roller 17 as a whole may be brought about, or because of great thermally deformed amount of the fluorine rubber, deformation of the nip portion with the pressurizing roller 2 may be sometimes caused to occur during prolonged stopping of the fixing roller 17. Therefore, the thickness of the oil barrier layer may be preferably 5 to 300 μm, more preferably 8 to 100 μm.

The off-set prevention layer 20 is formed after coating of, if necessary, a primer on the oil barrier layer F. The off-set prevention layer 20 should be preferably formed of a material having good wettability with the silicone oil of the release agent, and other than RTV silicone rubbers, LTV silicone rubbers can be also used.

The RTV silicone rubber may be either of one-liquid type or of two-liquid type, but a RTV silicone rubber of one-liquid type may be preferably used. This is because one-liquid type RTV silicone rubber has adhesiveness with the partner substance before vulcanization, and moreover finally adhesion with the oil barrier layer F of the off-set prevention layer 20 can be consolidated. Into the off-set prevention layer 20, fillers such as silica, blood red, etc. may be mixed suitably.

The method for forming the off-set prevention layer 20 should be preferably by way of knife coating, spray coating, etc. of a rubber such as LTV silicone rubber, RTV silicone rubber, etc. This is because, by use of the coating method such as knife coating or spray coating, the off-set prevention layer 20 can be formed easily as the thin layer by the free liquid surface of the rubber such as LTV silicone rubber or RTV silicone rubber coated, whereby the preparation device for formation of the off-set prevention layer 20 can be easily set, and productivity of the fixing roll 17 is excellent. Also, mold releasability of the off-set prevention layer 20 is improved.

Also, as described above, the off-set prevention layer 20 is formed after coating of, if necessary, a primer on the oil barrier layer F. For the primer, a primer comprising a silane coupling agent, etc. generally used in the prior art for adhesion of rubbers, etc. may be employed, but a silicone-varnish type primer, a primer comprising as mixture of silicone varnish and a silicone rubber or a silicone varnish of the block copolymer type may be also employed.

Here, elongations of the respective layers of the fixing roller 17 are set as follows.

| | |
|---|---|
| Elastic layer 18 (First elastic layer) | 250% |
| Oil barrier layer F (Second elastic layer) | 300% |
| Off-set prevention layer 20 (Third elastic layer) | 500% |

Here, the method for measuring the value of elongation of rubber is according to measurement of elongation in the vulcanized rubber physical testing method in JIS K6301.

Thus, by making elongation larger toward the surface layer side with larger deformation of the roller, namely making elongation larger in the order of the off-set prevention layer 20, the oil barrier layer F and the elastic layer 18, the stresses at the boundaries between the respective layers could be reduced greatly, whereby the successive copying life before peeling between the respective layers of the fixing roller could be improved to great extent.

In the following, Comparative examples showing the results depending on the difference in elongations between the respective layers are shown in Table 1.

TABLE 1

| | Elongation of first elastic layer (%) | Elongation of second elastic layer (%) | Elongation of third elastic layer (%) | Results of successive copying |
|---|---|---|---|---|
| Comparative | Large | Medium | Small | Peeled between the respective |

TABLE 1-continued

| | Elongation of first elastic layer (%) | Elongation of second elastic layer (%) | Elongation of third elastic layer (%) | Results of successive copying |
|---|---|---|---|---|
| example 1 | (300) | (250) | (200) | layers within 50,000 sheets of copying |
| Comparative example 2 | Small (150) | Large (300) | Medium (250) | Peeled between second elastic layer-third elastic layer within 50,000 sheets of copying |
| Comparative example 3 | Medium (250) | Small (150) | Large (500) | Peeled between first elastic layer-second elastic layer within 50,000 sheets of copying |
| Comparative example 4 | Large (300) | Small (150) | Medium (250) | Peeled between first elastic layer-second elastic layer within 50,000 sheets of copying |
| Comparative example 5 | Medium (250) | Large (300) | Small (200) | Peeled between second elastic layer-third elastic layer within 50,000 sheets of copying |
| Example of the invention | Small (250) | Medium (300) | Large (500) | OK for 100,000 sheets or more of copying |

Having described above about the oil barrier layer as a fluorine rubber, it is also possible to use a fluorosilicone rubber. However, with respect to barrier characteristic to oil, adhesiveness between the respective layers and the cost, fluorine rubber is the most preferred.

As described above, according to the present invention, since the third elastic layer which becomes the surface layer, the second layer which becomes the lower layer thereof, and first layer which becomes the lower layer thereof are larger in elongation in this order, occurrence of peeling between respective layers of plural number of layers can be prevented, whereby a rotatory member for fixing which can stand prolonged usage and a fixing device having the rotatory member can be provided. Particularly, when the second elastic layer is made an oil barrier layer, peeling at the oil barrier layer which has been the problem in the prior art can be surely prevented.

What is claimed is:

1. A rotatory member for fixing a toner image onto a support material supporting the toner image comprising:

a first rubber layer comprised of a first rubber;

a second rubber layer comprised of a second rubber and provided on said first rubber layer; and a third rubber layer comprised of a third rubber and provided on said second rubber layer as a surface layer, wherein elongation of said third rubber layer is larger than elongation of said second rubber layer and elongation of said second rubber layer is larger than elongation of said first rubber layer.

2. A rotatory member according to claim 1, wherein a release agent for preventing off-set of toner is supplied to said rotatory member.

3. A rotatory member according to claim 2, wherein said second rubber layer is a layer which prevents penetration of the release agent into said first rubber layer.

4. A rotatory member according to claim 3, wherein said release agent is a silicone oil.

5. A rotatory member according to any one of claim 1 to 4, wherein said first and third rubber layers are silicone rubber layers, and said second rubber layer is a fluorine rubber layer.

6. A rotatory member according to claim 1, further including a core member on which said first rubber layer is provided.

7. A rotatory member according to claim 1, wherein thickness of said first rubber layer is largest among said first to third rubber layers.

8. A fixing device for fixing a toner image onto a support material supporting the toner image comprising:

a pair of rotatory members for conveying said support material sandwiched therebetween, at least one of the pair of rotatory members having a first rubber layer comprised of a first rubber, a second rubber layer comprised of a second rubber and provided on the first rubber layer; a third rubber layer comprised of a third rubber and provided on the second rubber layer as a surface layer, elongation of said third rubber layer being larger than elongation of said second rubber layer and elongation of said second rubber layer being larger than elongation of said first rubber layer; and means fur supplying a release agent to at least one of said pair of rotatory members.

9. A fixing device according to claim 8, wherein said second rubber layer is a layer for preventing penetration of the release agent into said first rubber layer.

10. A fixing device according to claim 9, wherein said release agent is a silicone oil.

11. A fixing device according to any of claims 8 to 10, wherein the rotatory member having said first, second and third rubber layers is the rotatory member on the side in contact with unfixed toner image.

12. A fixing device according to claim 11, wherein said first and third rubber layers are silicone rubber layers, and said second rubber layer is a fluorine rubber layer.

13. A fixing device according to claim 8, wherein at least one of said pair of rotatory members is heated by heating means.

14. A fixing device according to claim 13, wherein said fixing device is used for a full-color image forming device.

15. A rotatory member according to claim 8, wherein said first to third rubber layer includes a core member on which said first rubber layer is provided.

16. A rotatory member according to claim 8, wherein thickness of said first rubber is largest among said first to third rubber layers.

* * * * *

UNITED STATES PATENT AND TRADEMARK OFFICE

CERTIFICATE OF CORRECTION

PATENT NO. 5,243,393

DATED September 7, 1993

INVENTOR(S) Takeshi MENJO

It is certified that error appears in the above-indentified patent and that said Letters Patent is hereby corrected as shown below:

Column 1

Line 8, "rolls," should read --rollers,-- and, "image," should read --image--.

Line 17, "roll" should read --roller--.

Line 19, "roll" should read --roller-- and, "widely" should read --widely practiced--.

Line 20, "rolls" should read --rollers--.

Line 24, "roll" should read --roller--.

Line 25, "roll" should read --roller--.

Line 66, ":s" should read --is--.

Column 2

Line 22, "arrowhead" should read --arrow--.

Column 3

Line 8, "playing" should read --having--.

Column 5

Line 65, "claim" should read --claims--.

UNITED STATES PATENT AND TRADEMARK OFFICE

CERTIFICATE OF CORRECTION

PATENT NO. 5,243,393

DATED September 7, 1993

INVENTOR(S) Takeshi MENJO

It is certified that error appears in the above-indentified patent and that said Letters Patent is hereby corrected as shown below:

Column 6

Line 41, "fur" should read --for--.

Line 51, "unfixed" should read --an unfixed--.

Line 63, "layer includes" should read --layers include--.

Line 66, "thickness" should read --the thickness-- and, "rubber" should read --rubber layers--.

Signed and Sealed this

Twenty-fourth Day of May, 1994

Bruce Lehman

*Attest:*

BRUCE LEHMAN

*Attesting Officer*

*Commissioner of Patents and Trademarks*